US010819059B2

(12) United States Patent
Aoki

(10) Patent No.: US 10,819,059 B2
(45) Date of Patent: Oct. 27, 2020

(54) CONNECTOR

(71) Applicant: YAZAKI CORPORATION, Tokyo (JP)

(72) Inventor: Eiji Aoki, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/684,542

(22) Filed: Nov. 14, 2019

(65) Prior Publication Data

US 2020/0161795 A1 May 21, 2020

(30) Foreign Application Priority Data

Nov. 20, 2018 (JP) ..... 2018-217002

(51) Int. Cl.

| | |
|---|---|
| ***H01R 13/44*** | (2006.01) |
| ***H01R 13/04*** | (2006.01) |
| ***H01R 13/11*** | (2006.01) |
| ***H01R 13/635*** | (2006.01) |
| ***H01R 13/64*** | (2006.01) |
| ***H01R 24/00*** | (2011.01) |
| *H01R 103/00* | (2006.01) |

(52) U.S. Cl.

CPC ..... *H01R 13/44* (2013.01); *H01R 13/04* (2013.01); *H01R 13/11* (2013.01); *H01R 13/635* (2013.01); *H01R 13/64* (2013.01); *H01R 24/00* (2013.01); *H01R 2103/00* (2013.01)

(58) Field of Classification Search

CPC ..... H01R 13/44

See application file for complete search history.

(56) References Cited

FOREIGN PATENT DOCUMENTS

JP 2014-53127 A 3/2014

*Primary Examiner* — Ross N Gushi

(74) *Attorney, Agent, or Firm* — Kenealy Vaidya LLP

(57) ABSTRACT

A connector including a female connector and a male connector is provided. The female connector has a female terminal, a female terminal accommodation portion, and a female-side finger-touch prevention portion. The female-side finger-touch prevention portion is arranged in an entrance of the female terminal accommodation portion, and is configured to generate a force for biasing toward a center of the opening in a state where the opening is enlarged in diameter with insertion of the male terminal. The male connector has a male terminal including a recess in an intermediate portion of an electrical contact portion. The recess of the male terminal is formed in a portion where the opening of the female-side finger-touch prevention portion can be fitted into the recess at a position before the male terminal contacts the female terminal and where the opening can be remove from the recess at a position after the male terminal contacts the female terminal.

6 Claims, 12 Drawing Sheets

4 7 20

CONNECTOR

CROSS-REFERENCE TO RELATED APPLICATIONS

This application is based on and claims priority under 35 USC 119 from Japanese Patent Application No. 2018-217002 filed on Nov. 20, 2018, the contents of which are incorporated herein by reference.

TECHNICAL FIELD

The present invention relates to a connector having a finger-touch prevention portion and a pre-lock structure.

BACKGROUND ART

In a high-voltage connector according to related art, for example, a finger-touch prevention portion is provided to prevent a finger of an operator from touching a terminal. The high-voltage connector disclosed in Patent Literature 1 below is a charging connector used in an electric automobile or the like, and the finger-touch prevention portion for a male terminal has a structure that moves along a terminal axial direction of the male terminal. When a male connector and a female connector are connector-fitted with each other, a housing of the female connector pushes the finger-touch prevention portion for the male terminal, and the exposed male terminal is connected to a female terminal with the pushing.

CITATION LIST

Patent Literature

Patent Literature 1: JP-A-2014-53127

SUMMARY OF INVENTION

There is a requirement specification that the high voltage connector has a pre-lock structure. The pre-lock structure is a structure for making a specification that physically requires a load before the male terminal contacts the female terminal during connector fitting. In order to satisfy the above specification, a lock structure different from a lock structure (for example, a lock structure using a locking arm and a locking hole) used for normal connector fitting is considered to be provided in each of the male connector housing and the female connector housing, but the size of the connector may be large. In the high-voltage connector in Patent Literature 1, no pre-lock structure is provided.

The present invention has been made in view of the above circumstances, and an object thereof is to provide a connector in which both a finger-touch prevention portion and a pre-lock structure can be provided without increasing the size.

According to a first aspect of the present invention made to solve the above problems, there is provided a connector having the following feature. That is, the connector includes a finger-touch prevention portion that is provided in an entrance portion of a female terminal accommodation portion, has an opening, and prevents a finger of an operator from touching a female terminal; and a male terminal that has a recess into which the opening is fitted at a position before the male terminal contacts a female terminal and from which the opening is removed at a position after the male terminal contacts the female terminal. The finger-touch prevention portion is configured to generate a force for biasing toward a center of the opening in a state where the opening is enlarged in diameter with insertion of the male terminal.

According to the present invention having the feature of the first aspect, since the opening of the finger-touch prevention portion is fitted into the recess of the male terminal during connector fitting, the opening is required to be pushed away from the recess to promote the connector fitting. Therefore, according to the present invention, a load can be physically applied before the male terminal contacts the female terminal. In addition, according to the present invention, the finger-touch prevention can be provided with a pre-lock structure. In the female connector, the finger-touch prevention portion and the pre-lock structure are not provided separately. According to the present invention, both the finger-touch prevention portion and the pre-lock structure can be provided without increasing the size.

According to a second aspect of the present invention, in the connector according to the first aspect, the finger-touch prevention portion includes a plurality of members that are displaced toward the center of the opening.

According to the present invention having the feature of the second aspect, it is effective to have the plurality of members that are displaced toward the center of the opening in order to provide the finger-touch prevention portion with the pre-lock structure together in the female connector, and the configuration can be provided.

According to a third aspect of the present invention, in the connector according to the first aspect, the finger-touch prevention portion includes an elastic member in which the opening is formed.

According to the present invention having the feature of the third aspect, it is effective to have the elastic member in which the opening is formed in order to provide the finger-touch prevention portion with the pre-lock structure together in the female connector, and the configuration can be provided.

According to a fourth aspect of the present invention, in the connector according to the first, second or third aspects, the recess is formed over an entire circumference around a terminal axis and has a substantially V-shape as viewed in cross section.

According to the present invention having the feature of the fourth aspect, since the recess is formed as a pre-lock structure in the male terminal and is formed in an annular shape having a substantially V-shape as viewed in cross section, the opening in the finger-touch prevention portion of the female connector can be smoothly inserted and removed, and the load physically applied is not excessively large. Therefore, according to the present invention, even if the pre-lock structure is provided, the workability of the connector fitting can be improved.

According to a fifth aspect of the present invention made to solve the above problems, there is provided a connector having the following feature. That is, the connector includes a female-side finger-touch prevention portion that is provided in an entrance portion of a female terminal accommodation portion, has an opening, and prevents a finger of an operator from touching a female terminal; and a male-side finger-touch prevention portion that is provided as a part of a male terminal, and has a recess into which the opening is fitted at a position before the male terminal contacts a female terminal and from which the opening is removed at a position after the male terminal contacts the female terminal.

According to the present invention having the feature of the fifth aspect, since the opening of the female-side finger-touch prevention portion is fitted into the recess of the male-side finger-touch prevention portion during connector fitting, a load can be physically applied before the male terminal contacts the female terminal similarly to above. According to the present invention, in the female connector and the male connector, pre-lock structures can be respectively provided in finger-touch prevention portions. In the female connector and the male connector, the finger-touch prevention portion and the pre-lock structure are not provided in separate structures. According to the present invention, both the finger-touch prevention portion and the pre-lock structure can be provided without increasing the size.

According to a sixth aspect of the present invention made to solve the above problems, there is provided a connector having the following feature. That is, the connector has a female connector and a meal connector. The female connector includes a female-side finger-touch prevention portion in an opening portion of a female terminal accommodation portion, and the male connector includes a male-side finger-touch prevention portion as a part of a male terminal. The female-side finger-touch prevention portion and the male-side finger-touch prevention portion respectively have structures in which the female connector and the male connector are at a pre-lock position when the female-side finger-touch prevention portion and the male-side finger-touch prevention portion are fitted.

According to the present invention having the feature of the sixth aspect, pre-lock structures can be respectively provided in finger-touch prevention portions of the female connector and the male connector, thereby preventing an increase in size.

According to the connector of the present invention, both the finger-touch prevention portion and the pre-lock structure can be provided without increasing the size.

BRIEF DESCRIPTION OF DRAWINGS

FIGS. 4A and 4B are views showing a pre-lock structure (a spring type) in a female-side finger-touch prevention portion, in which FIG. 4A is a configuration view, and FIG. 4B is a sectional view taken along a line A-A.

FIGS. 6A and 6B are views showing a pre-lock structure (a rubber type) in the female-side finger-touch prevention portion, in which FIG. 6A is a configuration view, and FIG. 6B is a sectional view taken along a line C-C.

FIGS. 8A and 8B are views showing a pre-lock structure (an aperture spring type) in the female-side finger-touch prevention portion, in which FIG. 8A is a configuration view, and FIG. 8B is a sectional view taken along a line E-E.

FIGS. 10A and 10B are views showing a pre-lock structure (a slide type) in the female-side finger-touch prevention portion, in which FIG. 10A is a configuration view, and FIG. 10B is a sectional view taken along a line G-G.

DESCRIPTION OF EMBODIMENTS

A female connector includes a female terminal, a female terminal accommodation portion and a finger-touch prevention portion. The finger-touch prevention portion is provided in an entrance portion of the female terminal accommodation portion, and is configured in a portion that are brought into a state where an opening is enlarged in diameter with insertion of a male terminal, and that generates a force for biasing toward a center of the opening in this state. On the other hand, a male connector includes a male terminal having a recess in an intermediate portion of an electrical contact portion. The recess of the male terminal is formed in a portion where the opening of the finger-touch prevention portion can be fitted into the recess at a position before the male terminal contacts the female terminal and where the opening thereof can be removed from the recess at a position after the male terminal contacts the female terminal.

First Embodiment

Figure 1:
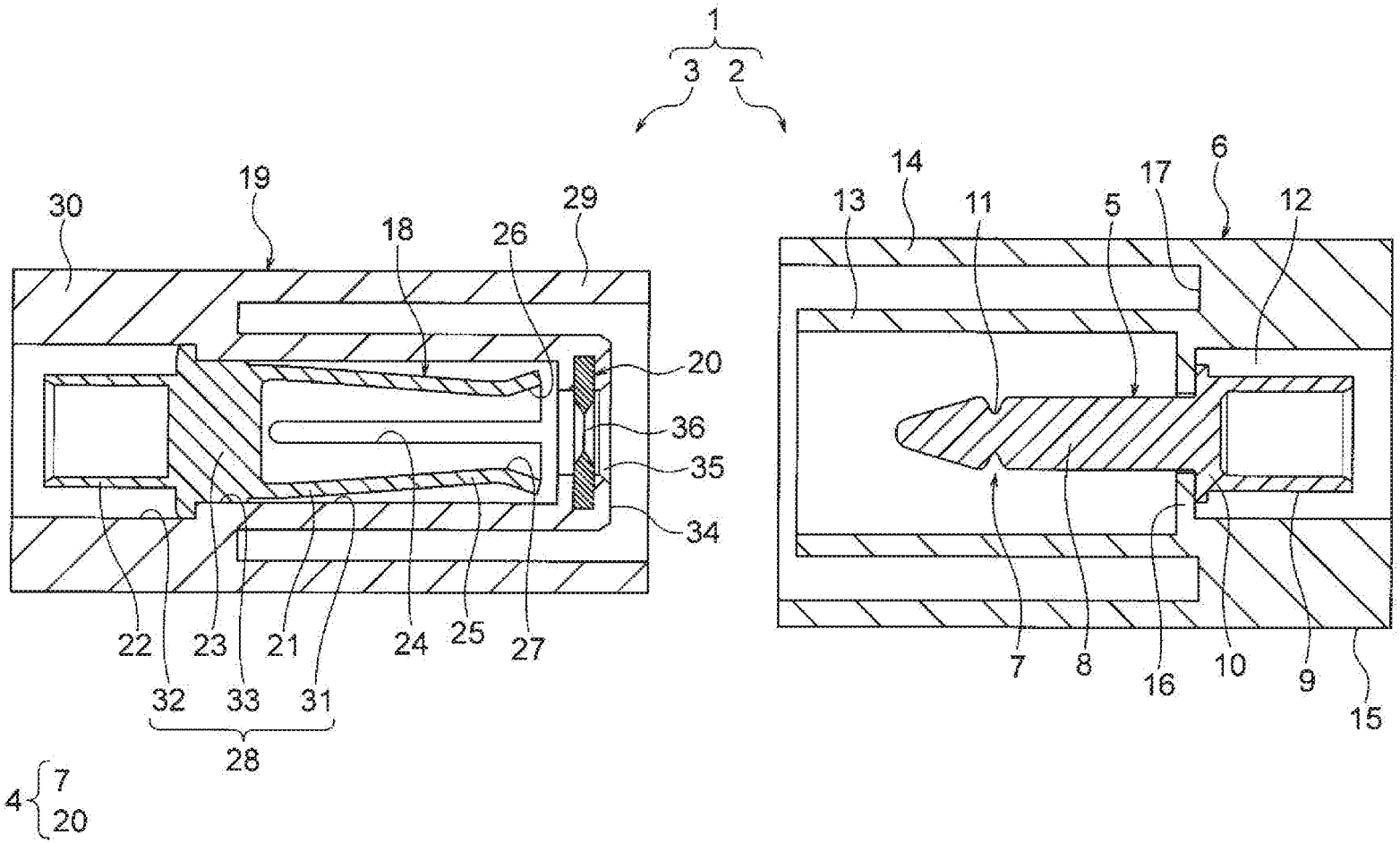
FIG. 1 is a sectional view showing a state before a male connector and a female connector are connector-fitted according to an embodiment of the connector of the present invention (a first embodiment).
Figure 2:
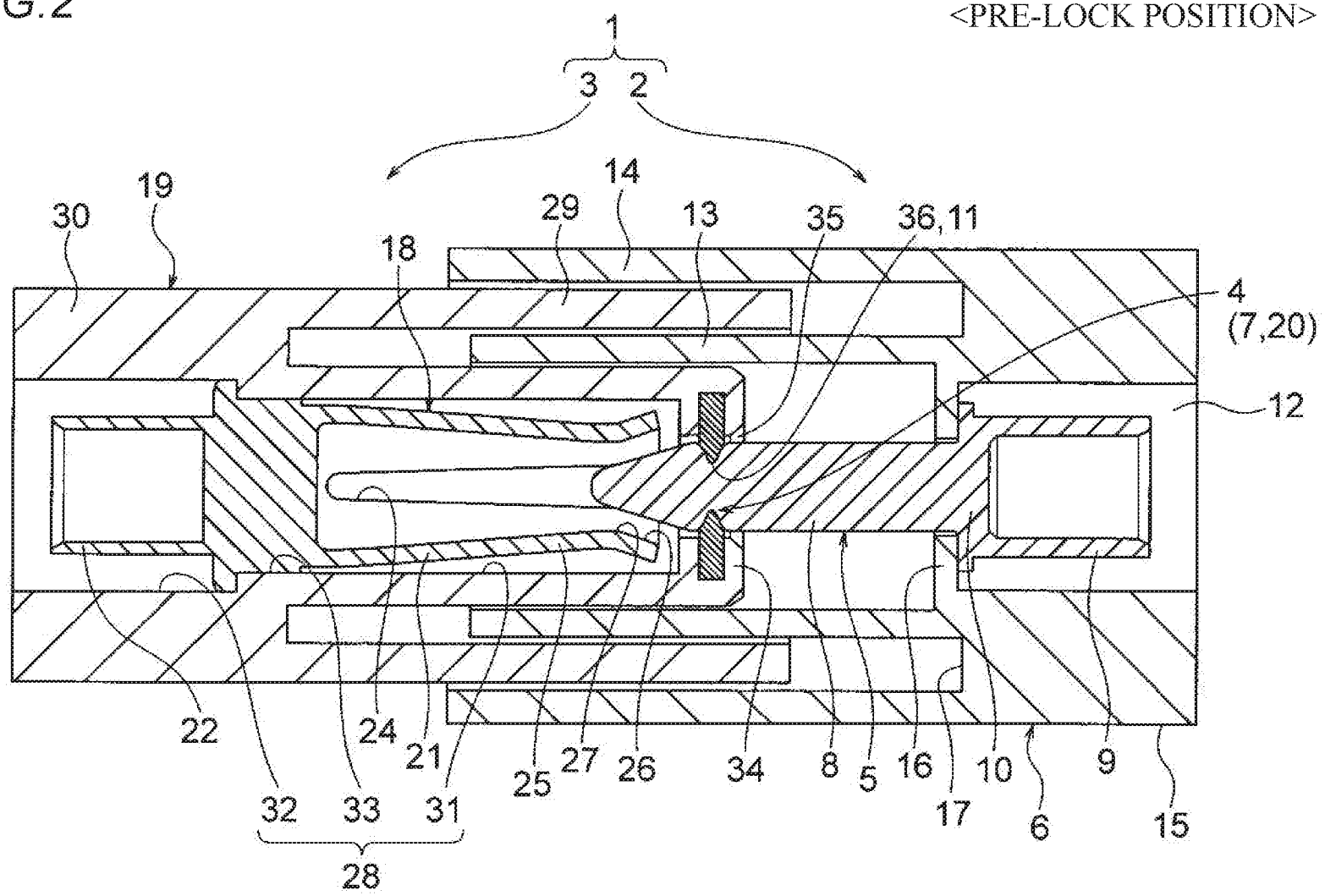
FIG. 2 is a sectional view showing a state at a pre-lock position during connector fitting.
Figure 3:
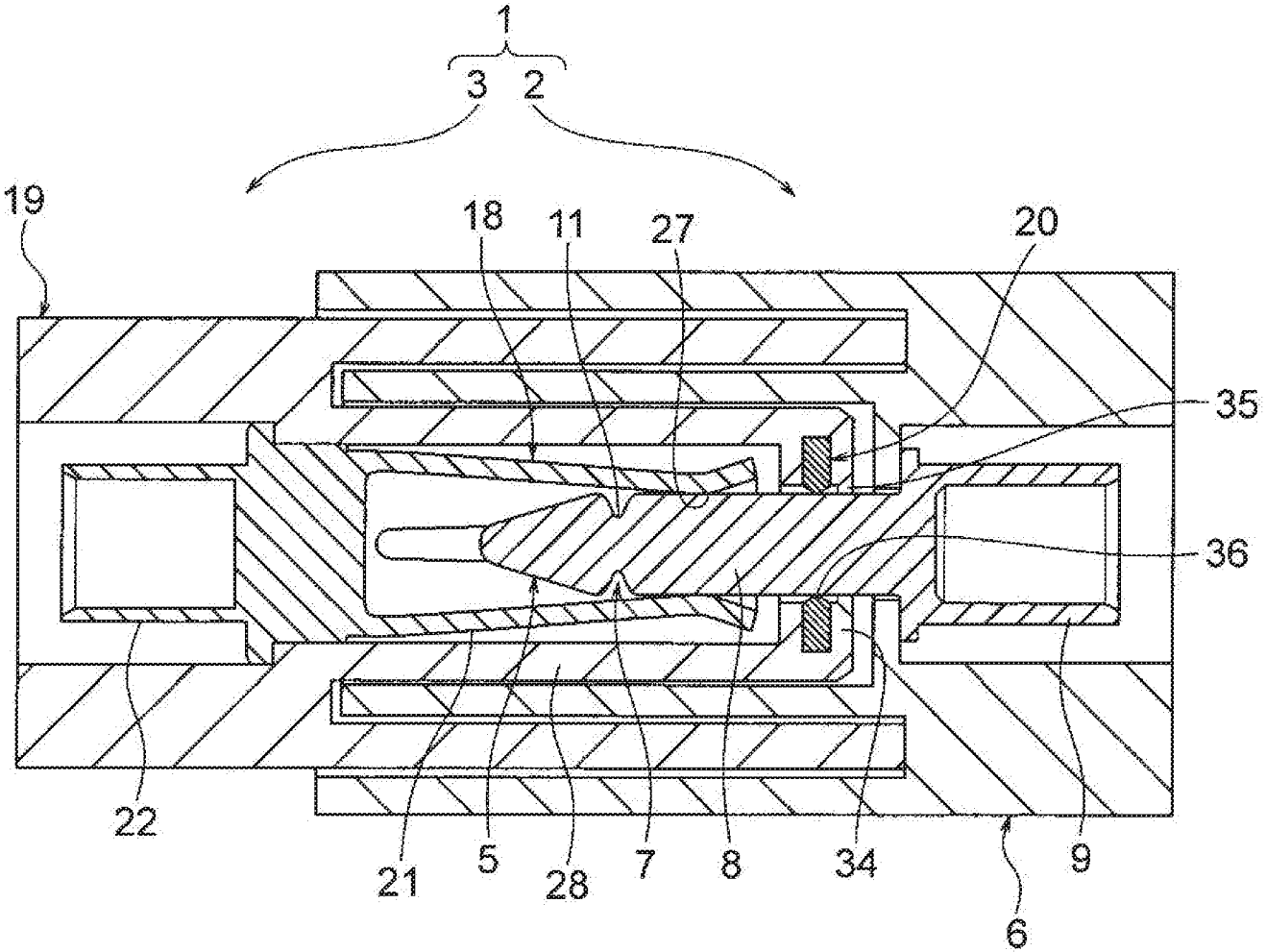
FIG. 3 is a sectional view showing a state after the connector fitting.

A first embodiment will be described below with reference to the drawings. FIG. 1 is a sectional view showing a state before a male connector and a female connector are connector-fitted according to an embodiment of a connector of the present invention. FIG. 2 is a sectional view showing a state at a pre-lock position during connector fitting. FIG. 3 is a sectional view showing a state after the connector fitting. FIGS. 4A to 11B are views showing types of pre-lock structures in a female-side finger-touch prevention portion.

<Connector 1>

In FIGS. 1 to 3, a connector 1 for electrical connection includes a male connector 2 and a female connector 3. The connector 1 shown in the drawings of the present embodiment is a simplified charging connector for charging a battery that supplies electric power to a motor mounted on an electric automobile, a hybrid automobile, an automatic driving vehicle or the like. Alternatively, the connector 1 is a simplified high-voltage connector provided at a terminal of a wire harness having a high voltage. The connector 1 is not limited to a connector for an automobile. The connector 1 is provided with a pre-lock structure 4 (collectively referred to as a male-side pre-lock structure 7 and a female-side pre-lock structure 20 described below).

<Male Connector 2>

In FIGS. 1 to 3, the male connector 2 includes a metal male terminal 5 having conductivity and a resin male connector housing 6 having insulation properties. The male connector 2 also includes the male-side pre-lock structure 7. In the first embodiment, the male connector 2 is characterized in that the male-side pre-lock structure 7 is provided.

<Male Terminal 5>

In FIGS. 1 to 3, the male terminal 5 includes an electrical contact portion 8, a wire connection portion 9 and a held portion 10, and is formed in an illustrated shape (the shape is an example). Although only one male terminal 5 is illustrated in the first embodiment, a plurality of male terminals 5 is actually provided. The male terminal 5 is provided as a member for directly performing electrical connection. A surface of the male terminal 5 is assumed to be plated. The electrical contact portion 8 is formed in a portion that is inserted into a female terminal 18 described below to be in electrical contact. Intermediate and proximal end portions of the electrical contact portion 8 are formed in a round pin shape. A distal end side of the electrical contact portion 8 is formed in a substantially bullet shape. Such an electrical contact portion 8 is provided with the male-side pre-lock structure 7 (described below). The wire connection portion 9 is formed as a connection portion with a wire terminal (not shown). The wire connection portion 9 of the first embodiment is formed in such a portion that a conductor exposed from the wire terminal can be connected by crimping (crimping connection or welding). The wire connection portion 9 is formed to have a diameter larger than that of the electrical contact portion 8. The held portion 10 is disposed between the electrical contact portion 8 and the wire connection portion 9. The held portion 10 is a portion held with respect to the male connector housing 6, includes a housing insertion portion (reference numeral omitted) continuous with the proximal end portion of the electrical contact portion 8 and a flange portion (reference numeral omitted) continuous with a proximal end portion of the wire connection portion 9, and is formed in a stepped shape.

<Male-Side Pre-Lock Structure 7>

In FIGS. 1 to 11B, the male-side pre-lock structure 7 is a characteristic portion of the male connector 2 and is disposed in the electrical contact portion 8 of the male terminal 5. Explaining the arrangement more specifically, the male-side pre-lock structure 7 is disposed in a portion (the intermediate portion of the male terminal 5) immediately after the electrical contact portion 8 changes from a substantially bullet shape on the distal end side to a round pin shape. The male-side pre-lock structure 7 has a recess 11 where an opening 36 of the female-side pre-lock structure 20 described below can be freely inserted and removed. The recess 11 is formed over the entire circumference around a terminal axis of the male terminal 5. The recess 11 is formed in a substantially V-shape as viewed in cross section. The recess 11 is formed in a shape having inclined surfaces as illustrated so that the opening 36 can be freely inserted and removed. Of course, a load described below can be changed by adjusting the angle of the inclined surfaces or the depth of the recess 11. One recess 11 is formed. The recess 11 is formed in an annular shape at a position on a plane orthogonal to the terminal axis. In a case of a second embodiment described below, the male-side pre-lock structure 7 is in the same position and shape, but is disposed on a male-side finger-touch prevention portion 50 (FIG. 12).

<Male Connector Housing 6>

In FIGS. 1 to 3, the male connector housing 6 is a resin molded article including a male terminal accommodation portion 12, an inner hood portion 13, an outer hood portion 14 and a housing rear portion 15, and is formed in an illustrated shape. The male connector housing 6 is provided as a member to be fitted with a female connector housing 19 described below of the female connector 3 during connector fitting, and as a member for insulating the plurality of male terminals 5 from each other and from outside. The male connector housing 6 is formed in a cylindrical portion on a fitting side with the female connector housing 19.

<Male Terminal Accommodation Portion 12>

In FIGS. 1 to 3, the male terminal accommodation portion 12 is formed in a portion that accommodates and holds the male terminal 5. Specifically, the male terminal accommodation portion 12 is formed in a portion that holds the housing insertion portion (reference numeral omitted) continuous with the proximal end portion of the electrical contact part 8, on which the flange portion (reference numeral omitted) continuous with the proximal end portion of the wire connection portion 9 abuts, and in which the wire connection portion 9 is located. The electrical contact portion 8 of the male terminal 5 penetrates a wall 16 and protrudes into the inner hood portion 13.

<Inner Hood Portion 13 and Outer Hood Portion 14>

In FIGS. 1 to 3, the inner hood portion 13 is formed in a portion in which the electrical contact portion 8 of the male terminal 5 protrudes. The inner hood portion 13 is formed in a portion, opened at a front end thereof, into which a female terminal accommodation portion 28 described below of the female connector 3 is inserted. The outer hood portion 14 is formed in a portion surrounding the inner hood portion 13 with a predetermined interval. The outer hood portion 14 is formed in a portion into which a hood portion 29 described below of the female connector 3 is inserted. A deep portion 17 between the inner hood portion 13 and the outer hood portion 14 is formed in a portion on which a distal end of the hood portion 29 abuts in the connector fitting. A male-side lock portion (not shown) as a lock structure in the connector fitting is formed in the outer hood portion 14. The lock structure corresponds to, for example, a locking arm of the female connector 3 and a locking hole of the male connector 2.

<Female Connector 3>

In FIGS. 1 to 3, the female connector 3 includes the metal female terminal 18 having conductivity and the resin female connector housing 19 having insulation properties. The female connector 3 also includes the female-side pre-lock structure 20. In the first embodiment, the female connector 3 is characterized in that the female-side pre-lock structure 20 is provided so as to be integrated with a female-side finger-touch prevention portion 34 described below.

<Female Terminal 18>

In FIGS. 1 to 3, the female terminal 18 includes an electrical contact portion 21, a wire connection portion 22 and a held portion 23, and is formed in an illustrated shape (the shape is an example). Although only one female terminal 18 is illustrated in the first embodiment, a plurality of female terminals 18 are actually provided in accordance with the number of male terminals 5. The female terminal 18 is provided as a member for directly performing electrical connection. A surface of the female terminal 18 is assumed to be plated. The electrical contact portion 21 is formed in a portion into which the electrical contact portion 8 of the male terminal 5 is inserted to be in electrical contact. The electrical contact portion 21 includes a plurality of slits 24 and a plurality of elastic contact pieces 25, and is formed in a slot shape. A guide portion 26 for the electrical contact portion 8 of the male terminal 5 and a contact 27 for the electrical contact portion 8 are formed on a distal end side of the elastic contact piece 25. The elastic contact piece 25 is formed as an arc-shaped plate piece inclined inward from a proximal end portion of the electrical contact portion 21 toward the contact point 27. The wire connection portion 22 is formed as a connection portion with a wire terminal (not shown). The wire connection portion 22 of the present embodiment is formed in such a portion that a conductor exposed from the wire terminal can be connected by crimping (crimping connection or welding). The wire connection portion 22 is formed to have a diameter slightly smaller than that of the proximal end portion of the electrical contact portion 21. The held portion 23 is disposed between the electrical contact portion 21 and the wire connection portion 22. The held portion 23 is a portion held with respect to the female connector housing 19, includes a housing insertion portion (reference numeral omitted) continuous with the proximal end portion of the electrical contact portion 21 and a flange portion (reference numeral omitted) continuous with a proximal end portion of the wire connection portion 22, and is formed in a stepped shape.

<Female Connector Housing 19>

In FIGS. 1 to 3, the female connector housing 19 is a resin molded article including the female terminal accommodation portion 28, the hood portion 29 and a housing rear portion 30, and is formed in an illustrated shape. The female connector housing 19 is provided as a member to be fitted with the male connector housing 6 of the male connector 2 during the connector fitting, and as a member for insulating the plurality of female terminals 18 from each other and from the outside. The female connector housing 19 (the hood portion 29) is formed in a cylindrical portion on a fitting side with the male connector housing 6.

<Female Terminal Accommodation Portion 28>

In FIGS. 1 to 3, the female terminal accommodation portion 28 is formed in a portion that accommodates and holds the female terminal 18. Specifically, the female terminal accommodation portion 28 is formed in an illustrated portion including a first accommodation portion 31 that accommodates the electrical contact portion 21, a second accommodation portion 32 that accommodates the wire connection portion 22, and a terminal holding portion 33 disposed between the first accommodation portion 31 and the second accommodation portion 32. The first accommodation portion 31 is formed such that a distal end thereof is the female-side finger-touch prevention portion 34. The female-side finger-touch prevention portion 34 is a portion for preventing a finger of an operator from touching the female terminal 18, for example. In the first embodiment, the female-side finger-touch prevention portion 34 corresponds to the entire distal end portion of the first accommodation portion 31. An entrance 35 is formed at the distal end of the first accommodation portion 31 (in the female-side finger-touch prevention portion 34). The entrance 35 is formed in a hole-shaped portion into which the electrical contact portion 8 of the male terminal 5 is inserted (passes). The female-side pre-lock structure 20 (described below) is disposed so as to be integrated with such an entrance 35. The female terminal accommodation portion 28 is formed in a portion where the housing insertion portion (reference numeral omitted) continuous with the proximal end portion of the electrical contact portion 21 is held by the terminal holding portion 33, the flange portion (reference numeral omitted) continuous with the proximal end portion of the wire connection portion 22 abuts on the terminal holding portion 33, and the electrical contact portion 21 and the wire connection portion 22 are located in the first accommodation portion 31 and the second accommodation portion 32.

<Hood Portion 29>

In FIGS. 1 to 3, the hood portion 29 is formed in a portion surrounding the female terminal accommodation portion 28 with a predetermined interval. The hood portion 29 is formed in a portion that is inserted between the inner hood portion 13 and the outer hood portion 14 of the male connector 2, and whose distal end abuts on the deep portion 17 of the male connector 2. The hood portion 29 is formed in a portion protruding more than the distal end of the first accommodation portion 31 (the female-side finger-touch prevention portion 34). The hood portion 29 is provided with a female-side lock portion (not shown, for example, corresponding to the locking arm described above) as a lock structure in the connector fitting.

<Female-Side Pre-Lock Structure 20>

In FIGS. 1 to 11, the female-side pre-lock structure 20 is a characteristic portion of the female connector 3, and is disposed in the entrance 35 of the female-side finger-touch prevention portion 34 (the distal end of the female terminal accommodation portion 28) as described above. The female-side pre-lock structure 20 has the circular opening 36, and is formed in a portion that is brought into a state where the opening 36 is enlarged in diameter with insertion of the electrical contact portion 8 of the male terminal 5, and that generates a force for biasing toward a center of the opening 36 in the diameter-enlarged state. The female-side pre-lock structure 20 is formed in a protruding portion having a substantially V-shape as viewed in cross section so that an edge portion of the opening 36 can be freely inserted into and removed from the recess 11 of the male-side pre-lock structure 7. One female-side pre-lock structure 20 is disposed in the female-side finger-touch prevention portion 34. Hereinafter, four types of specific examples of the female-side pre-lock structure 20 will be described respectively with reference to FIGS. 4 to 11.

<Female-Side Pre-Lock Structure 20 of Spring Type>

Figure 4B:
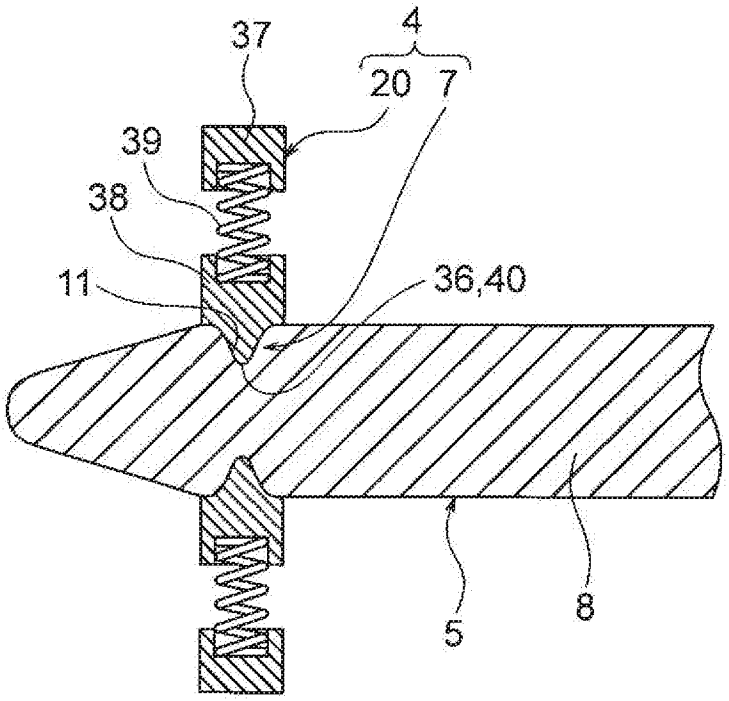
Figure 4A:
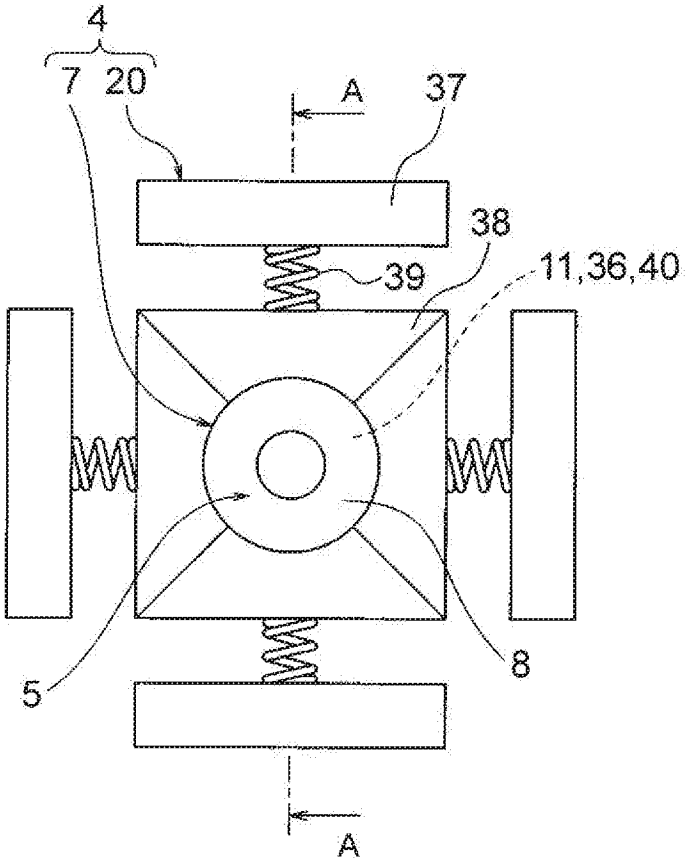
Figure 5B:
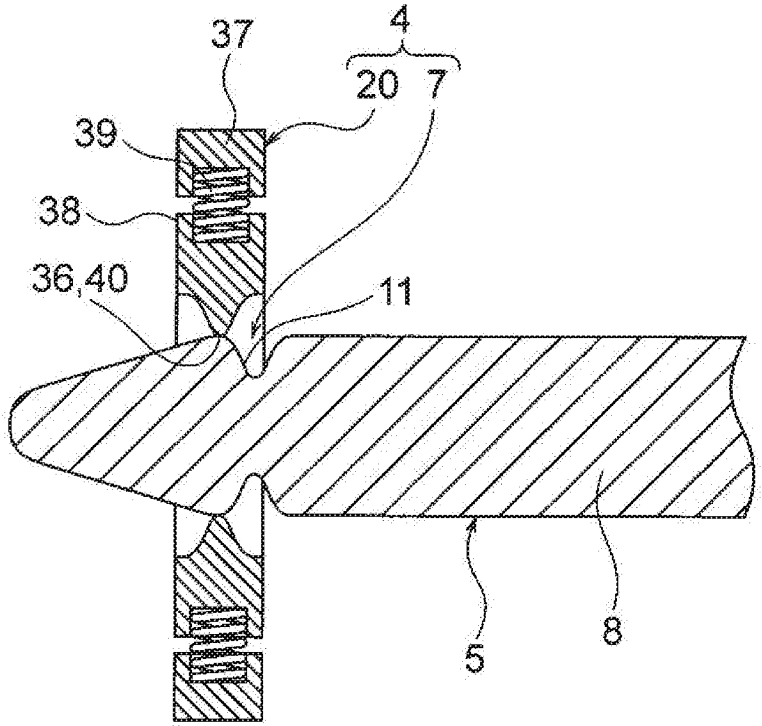
FIG. 5B is a sectional view taken along a line B-B.
Figure 5A:
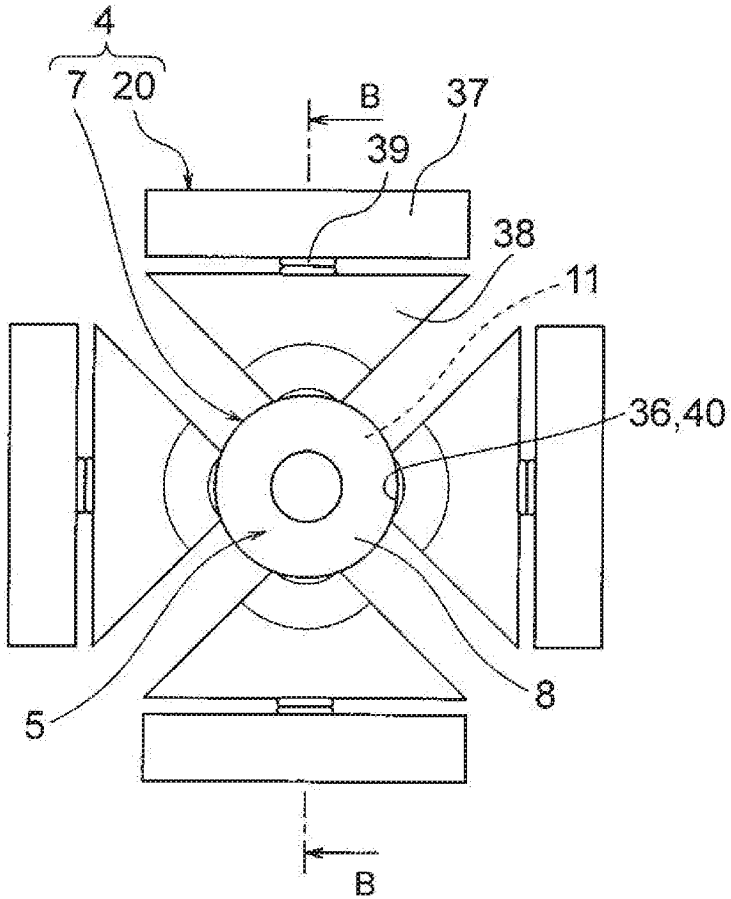
FIG. 5A is a view showing a state in which an opening in FIG. 4A is enlarged in diameter.

In FIGS. 4 and 5, the female pre-lock structure 20 here is of a spring type. Hereinafter, the female-side pre-lock structure 20 is abbreviated as "spring type". The spring type includes four fixed members 37 fixed to the female-side finger-touch prevention portion 34 (see FIGS. 1 to 3), four movable members 38 that protrude and retract in the entrance 35 (see FIGS. 1 to 3), and four coil springs 39 whose one end is fixed to the fixed member 37 and the other end is fixed to the movable member 38. The fixed member 37, the movable member 38 and the coil spring 39 are disposed at a pitch of 90 degrees in the first embodiment. In addition, the three members may be configured to be disposed at a pitch of 120 degrees, for example. The spring type is brought into a state where the opening 36 is enlarged in diameter with the insertion of the male terminal 5, and generates a force for biasing toward the center of the opening 36 in the diameter-enlarged state. A reference numeral 40 in the opening 36 denotes an arc portion. The arc portion 40 (the opening 36) is formed in a protruding portion having a V-shape as viewed in cross section. The four movable members 38 are members that are displaced toward the center of the opening 36.

<Female-Side Pre-Lock Structure 20 of Rubber Type>

Figure 6B:
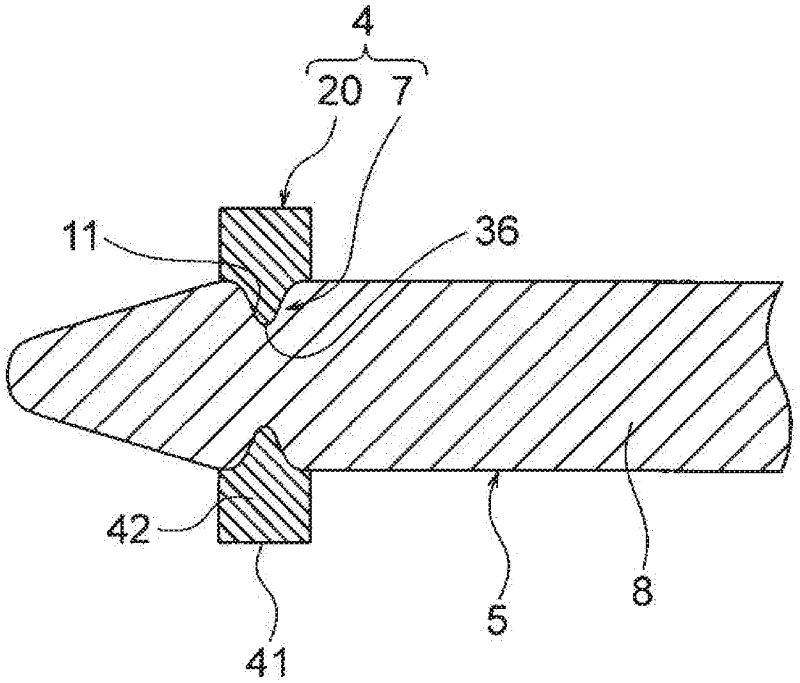
Figure 6A:
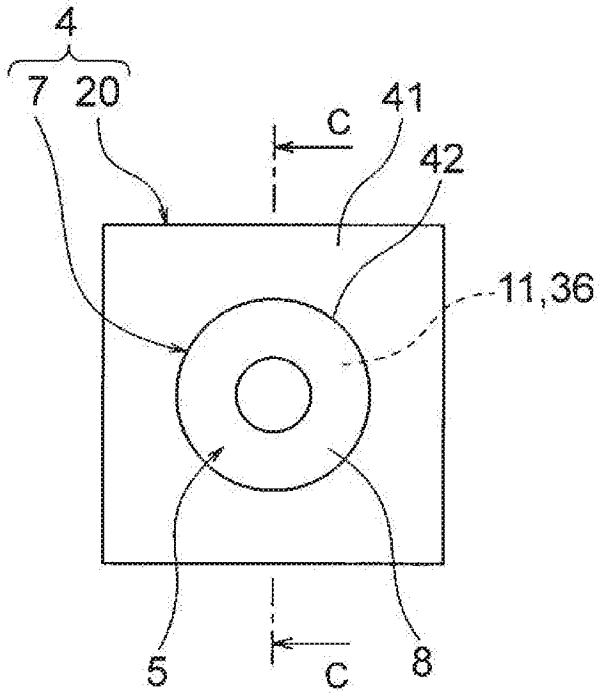
Figure 7B:
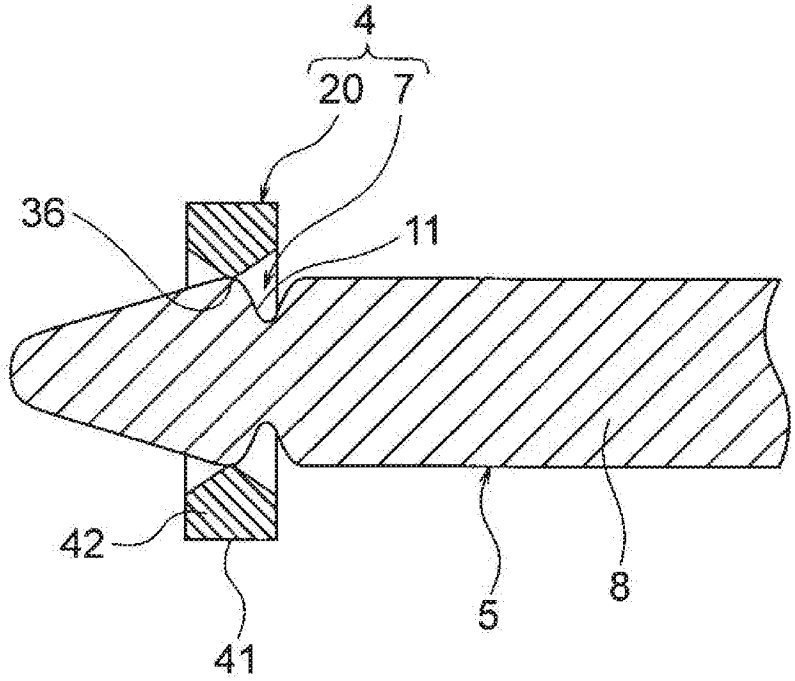
FIG. 7B is a cross-sectional view taken along a line D-D.
Figure 7A:
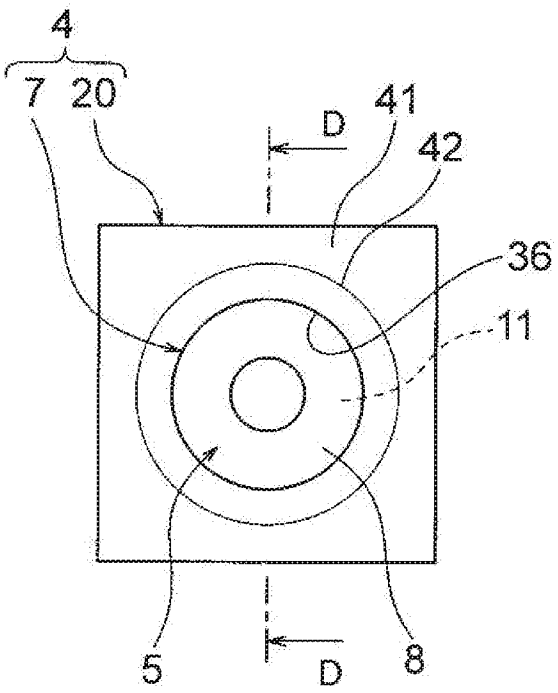
FIG. 7A is a view showing a state in which an opening in FIG. 6 is enlarged in diameter.

In FIGS. 6 and 7, the female-side pre-lock structure 20 here is of a rubber type. Hereinafter, the female-side pre-lock structure 20 is abbreviated as "rubber type". The rubber type is a rubber (or elastomer) member (an elastic member) having elasticity as a whole, includes a circumferential fixed portion 41 fixed to the female-side finger-touch prevention portion 34 (see FIGS. 1 to 3), an elastic movable portion 42 that protrudes and retracts in the entrance 35 (see FIGS. 1 to 3) and the opening 36, and is formed in an illustrated shape. The opening 36 is formed in a protruding portion having a V-shape as viewed in cross section. The rubber type is brought into a state where the opening 36 is enlarged in diameter with the insertion of the male terminal 5, and generates a force for biasing toward the center of the opening 36 in the diameter-enlarged state. The elastic movable portion 42 is displaced toward the center of the opening 36.

<Female-Side Pre-Lock Structure 20 of Aperture Spring Type>

Figure 8B:
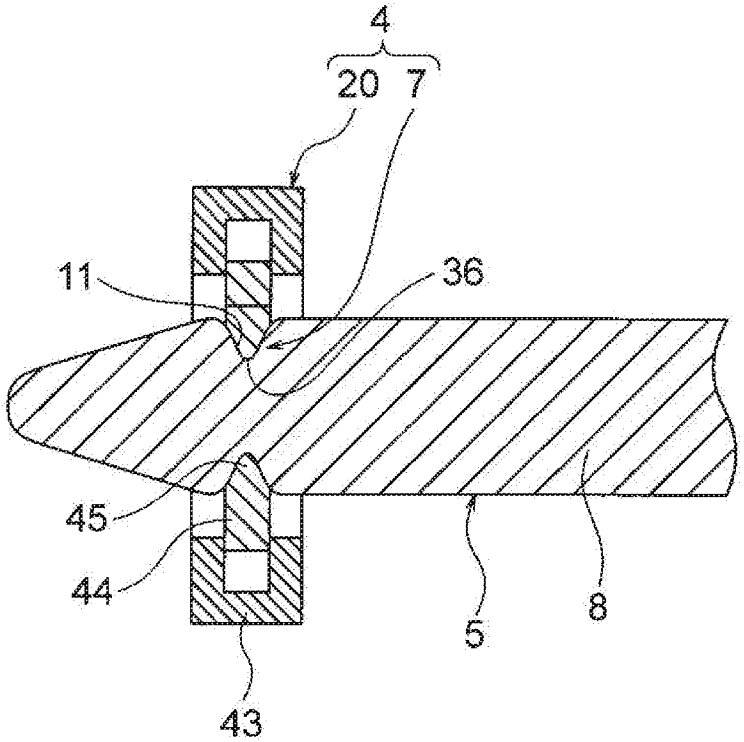
Figure 8A:
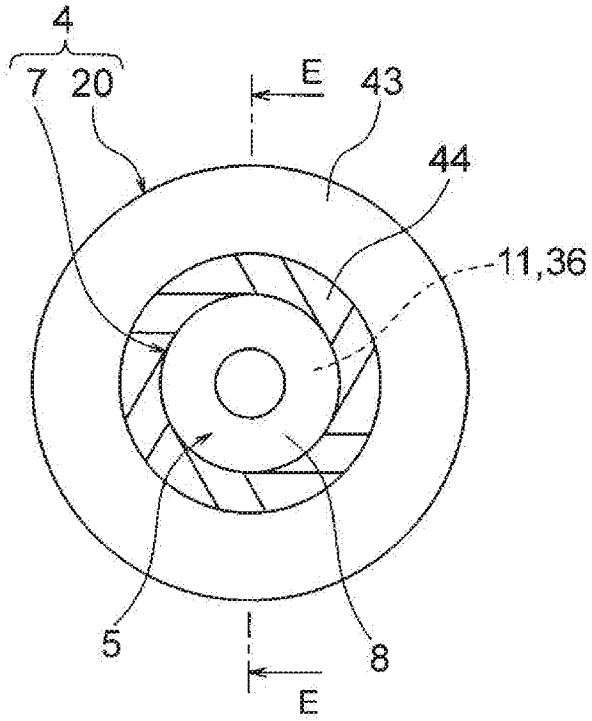
Figure 9B:
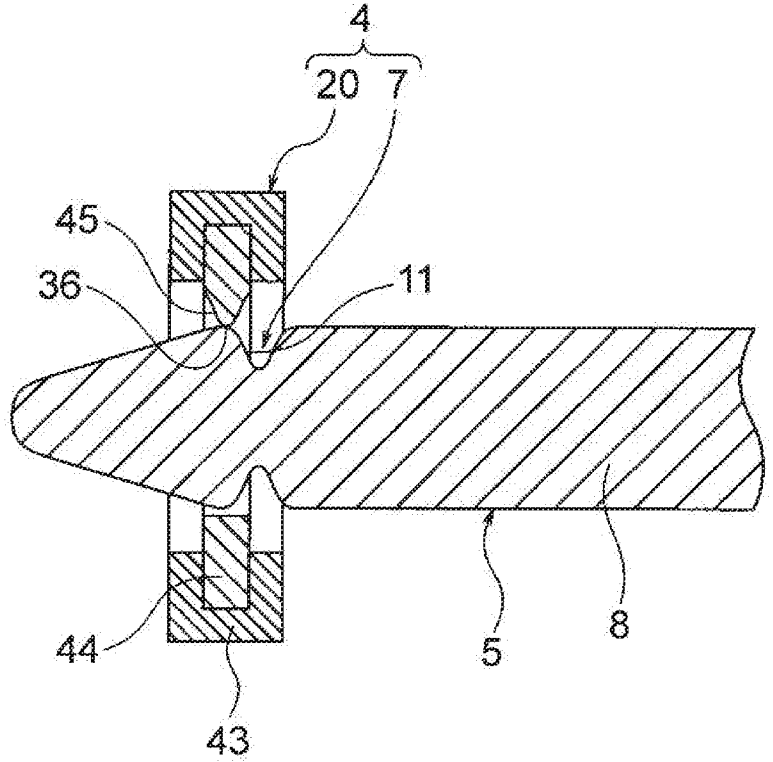
FIG. 9B is a sectional view taken along a line F-F.
Figure 9A:
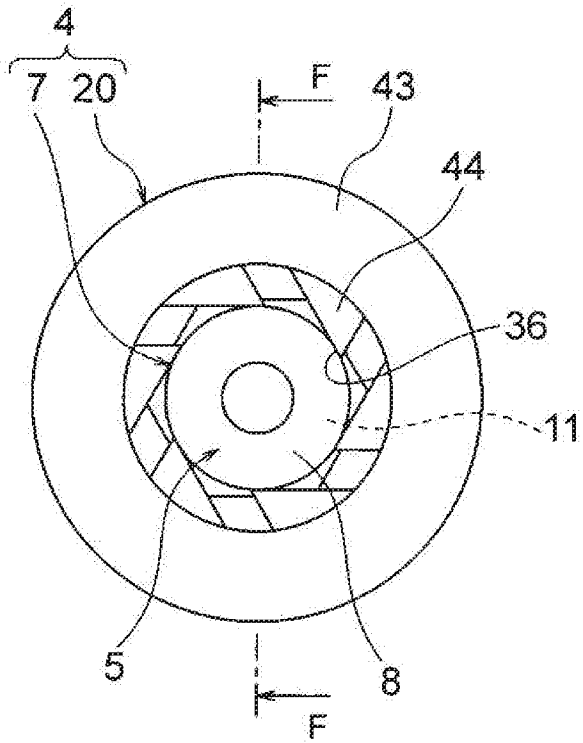
FIG. 9A is a view showing a state in which an opening in FIG. 8 is enlarged in diameter.

In FIGS. 8 and 9, the female-side pre-lock structure 20 here is of an aperture spring type. Hereinafter, the female-side pre-lock structure 20 is abbreviated as "aperture spring type". The aperture spring type includes an annular fixed member 43 fixed to the female-side finger-touch prevention portion 34 (see FIGS. 1 to 3), an aperture spring 44 including a plurality of movable members that protrude and retract in the entrance 35 (see FIGS. 1 to 3), and the opening 36. The aperture spring type is brought into a state where the opening 36 is enlarged in diameter with the insertion of the male terminal 5, and generates a force for biasing toward the center of the opening 36 in the diameter-enlarged state. A reference numeral 45 in the opening 36 denotes a protruding portion. The protruding portion 45 is formed in a V-shaped portion as viewed in cross section. The aperture spring 44 including the plurality of movable members is a member that is displaced toward the center of the opening 36. The aperture spring 44 is a member that is displaced in a state like an aperture of a camera shutter.

<Female-Side Pre-Lock Structure 20 of Slide Type>

Figure 10B:
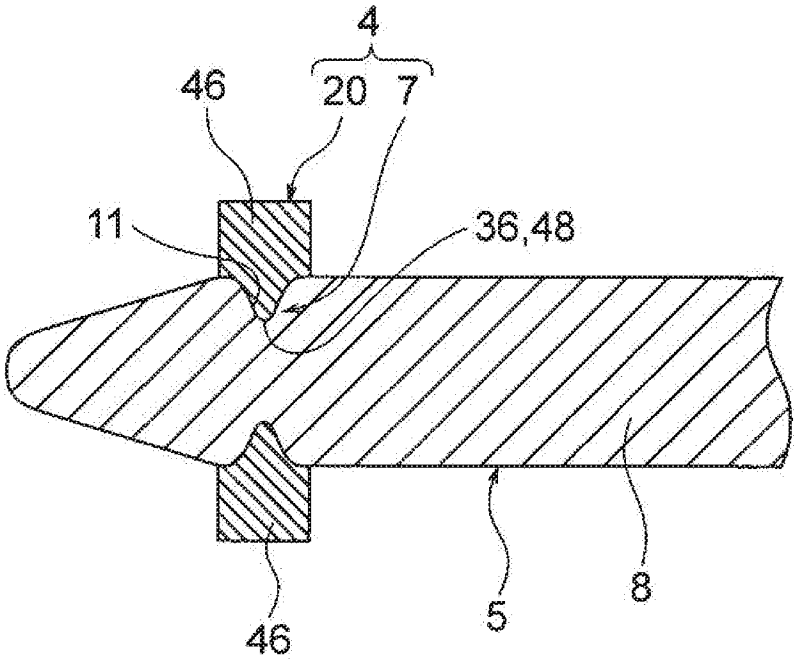
Figure 10A:
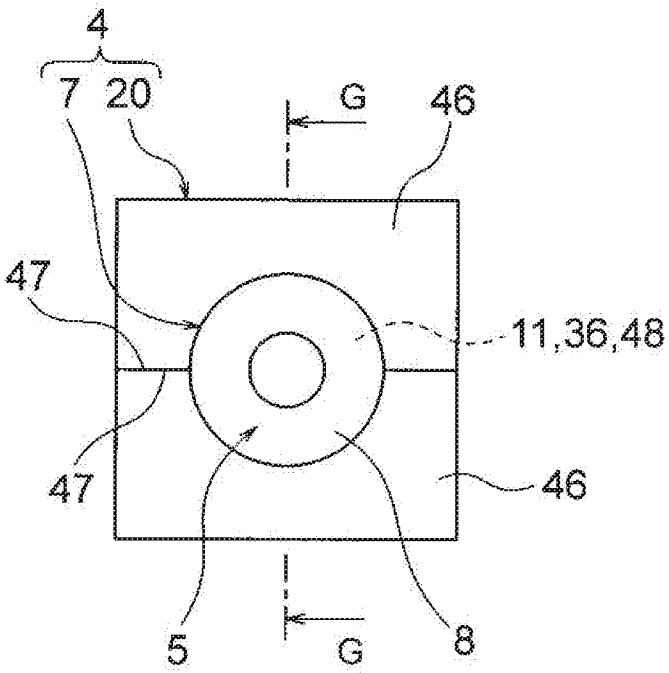
Figure 11B:
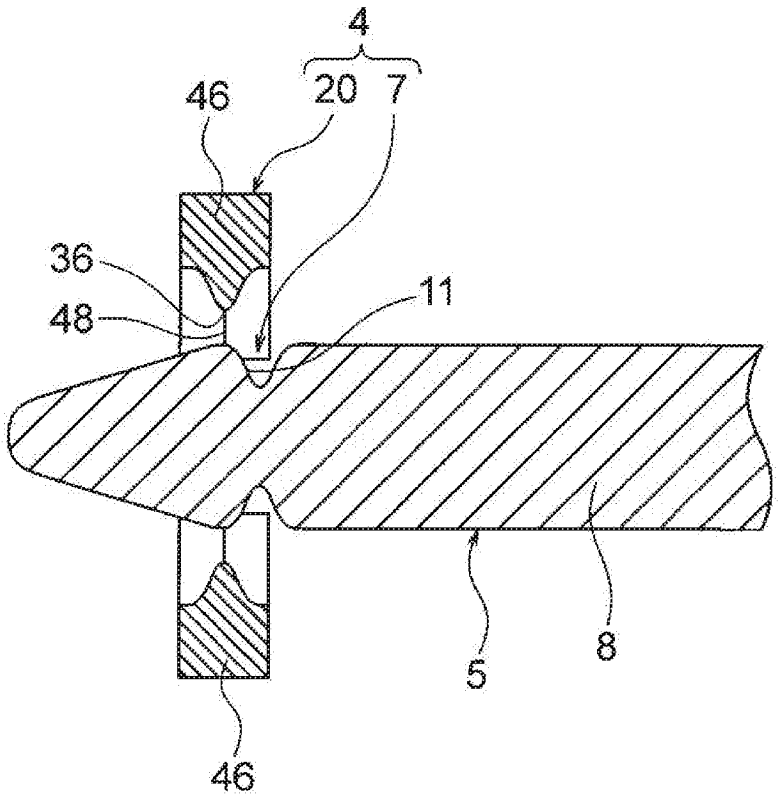
FIG. 11B is a sectional view taken along a line H-H.
Figure 11A:
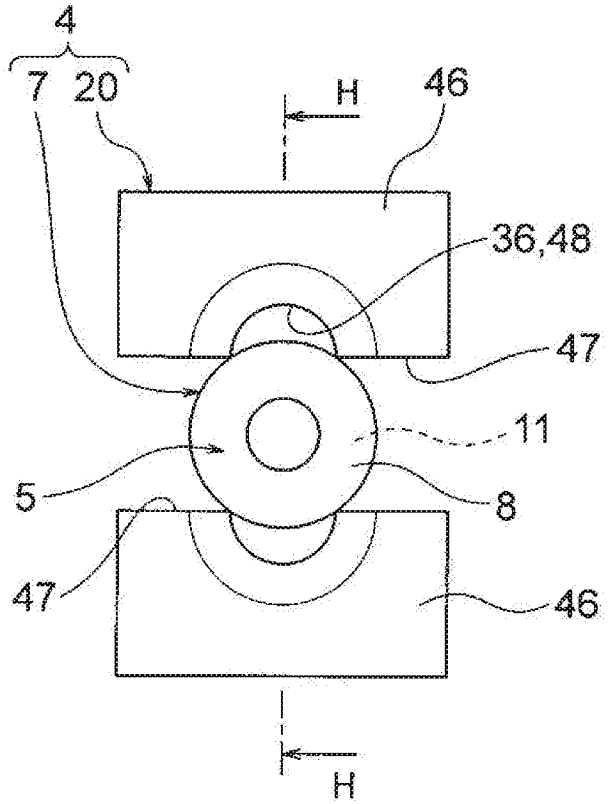
FIG. 11A is a view showing a state in which an opening in FIG. 10 is enlarged in diameter.
Figure 12:
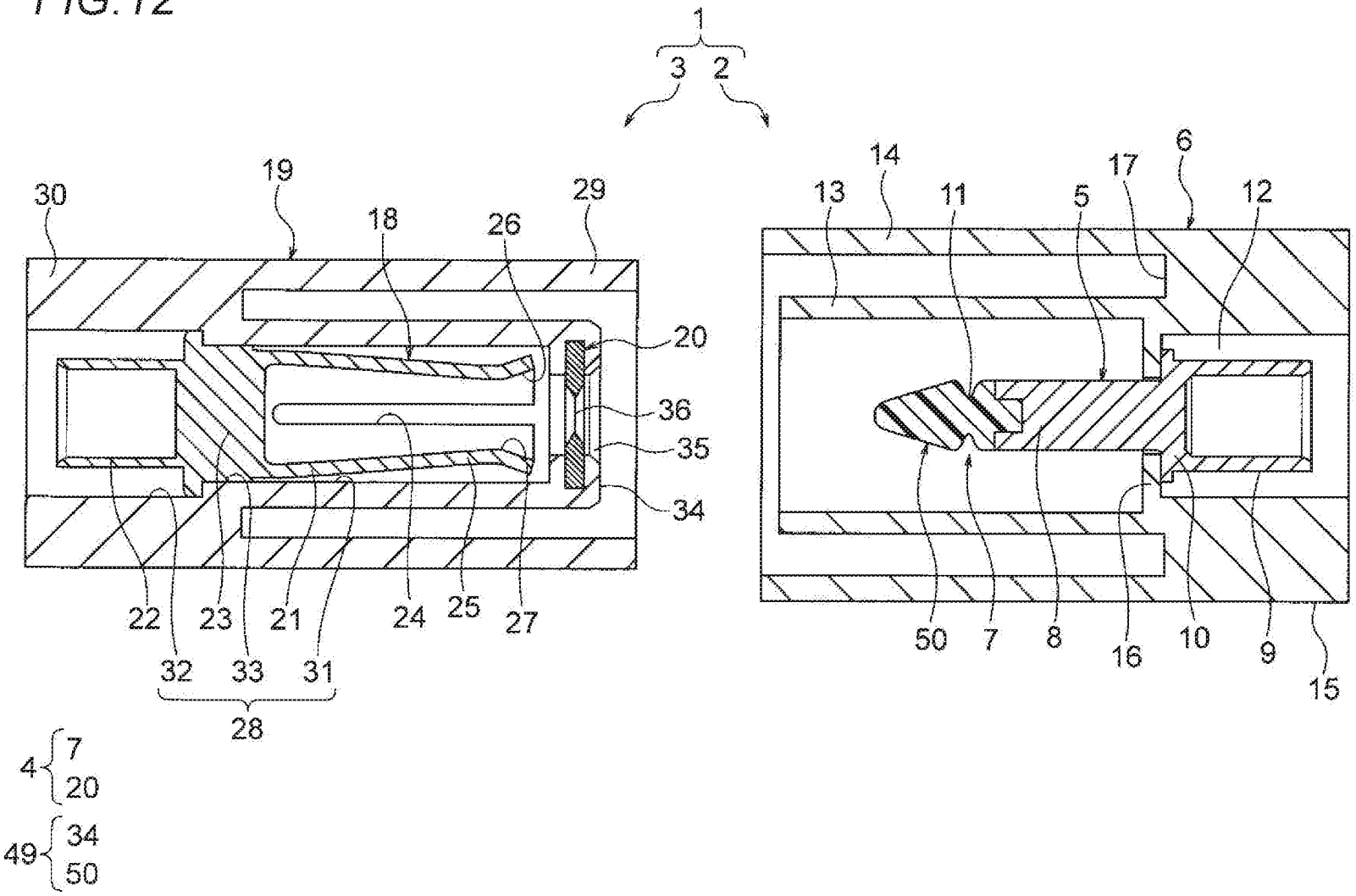
FIG. 12 is a sectional view showing a state before a male connector and a female connector are connector-fitted according to another embodiment of the connector of the present invention (a second embodiment).

In FIGS. 10 and 11, the female-side pre-lock structure 20 here is of a slide type. Hereinafter, the female-side pre-lock structure 20 is abbreviated as "slide type". The slide type is, for example, a modification of the "spring type" described above, and includes two fixed members (not shown here, but the fixed member 37 in FIGS. 4 and 5 serves as a reference) fixed to the female-side finger-touch prevention portion 34 (see FIGS. 1 to 3), two slide movable members 46 that protrude and retract in the entrance 35 (see FIGS. 1 to 3), and two coil springs (not shown here, but the coil spring 39 in FIGS. 4 and 5 serves as a reference) whose one end is fixed to the fixed member and the other end is fixed to the slide movable member 46. A structure may be provided in which the coil springs are disposed at positions of dividing surfaces 47 of the two slide movable members 46 without using the fixed member. The slide type is brought into a state where the opening 36 is enlarged in diameter with the insertion of the male terminal 5, and generates a force for biasing toward the center of the opening 36 in the diameter-enlarged state. A reference numeral 48 in the opening 36 denotes an arc portion. The arc portion 48 (the opening 36) is formed in a protruding portion having a V-shape as viewed in cross section. The two slide movable members 46 are members that are displaced toward the center of the opening 36.

<Operation of Pre-Lock Structure 4>

In FIG. 1, the pre-lock structure 4 (the male-side pre-lock structure 7 and the female-side pre-lock structure 20) is in a state before the male connector 2 and the female connector 3 are connector-fitted, so that the opening 36 is in a small diameter state without the diameter enlarged in the state before fitting. In FIG. 2, when the connector fitting is started and the fitting is in process, the opening 36 is enlarged in diameter with the insertion of the male terminal 5. Thereafter, the opening 36 is fitted into the recess 11 by the biasing force. At this time, the male connector 2 and the female connector 3 (the pre-lock structure 4) are located at a pre-lock position. That is, when no load is applied in a connector fitting direction, the male terminal 5 does not move toward the female terminal 18. In FIG. 3, when a load is applied, the opening 36 is enlarged in diameter again to disengage from the recess 11, and then the connector fitting is completed as shown in FIG. 3. In a connector fitting state, the contact 27 of the female terminal 18 contacts the electrical contact portion 8 of the male terminal 5.

<Effects of Connector 1>

As described above with reference to FIGS. 1 to 11, according to the connector 1 in an embodiment of the present invention, since the opening 36 of the female-side pre-lock structure 20 in the female-side finger-touch prevention portion 34 is fitted into the recess 11 in the intermediate portion of the male terminal 5 during connector fitting, the load can be physically applied before the male terminal 5 contacts the female terminal 18 as described above. According to the connector 1, as can be seen from the above structure, the female-side pre-lock structure 20 can be provided in the female-side finger-touch prevention portion 34. That is, in the female connector 3, the female-side finger-touch prevention portion 34 and the female-side pre-lock structure 20 are not separately provided. Therefore, according to the connector 1, both the female-side finger-touch prevention portion 34 and the female-side pre-lock structure 20 can be provided without increasing the size.

Second Embodiment

A second embodiment will be described below with reference to the drawings. FIG. 12 is a sectional view showing a state before a male connector and a female connector are connector-fitted according to another embodiment of the connector of the present invention. The substantially same components as those in the first embodiment are denoted by the same reference numerals, and a detailed description thereof is omitted.

<Connector 1>

In FIG. 12, the connector 1 according to the second embodiment includes the male connector 2 and the female connector 3 as in the first embodiment. The connector 1 is provided with the pre-lock structure 4 (collectively referred to as the male-side pre-lock structure 7 and the female-side pre-lock structure 20). In addition, the connector 1 is also provided with the pre-lock structure 4 including a finger-touch prevention portion 49 (collectively referred to as the female-side finger-touch prevention portion 34 and a male-side finger-touch prevention portion 50 described below).

<Male-Side Finger-Touch Prevention Portion 50 and Male-Side Pre-Lock Structure 7>

In FIG. 12, the male-side finger-touch prevention portion 50 is a resin molded article having insulating properties, and is disposed in the male terminal 5. As compared with the first embodiment shown in FIG. 1, the male-side finger-touch prevention portion 50 is disposed at a position that is a portion from the distal end portion to the intermediate portion of the electrical contact portion 8 of the male terminal 5 according to the first embodiment. The male-side finger-touch prevention portion 50 is, for example, a portion for preventing the finger of the operator from touching the male terminal 5. The male-side finger-touch prevention portion 50 includes a portion formed in a substantially bullet shape, a portion formed in a columnar shape, and a portion fixed to the electrical contact portion 8 (reference numerals omitted). The male-side pre-lock structure 7 is disposed in a portion formed in the columnar shape. The male-side pre-lock structure 7 has the recess 11.

<Effects of Connector 1 According to Second Embodiment>

As described above with reference to FIG. 12, according to the connector 1 in another embodiment of the present invention, the connector 1 is mated with the connector 1, since the opening 36 of the female-side pre-lock structure 20 in the female-side finger-touch prevention portion 34 is fitted into the recess 11 of the male-side pre-lock structure 7 in the male-side finger-touch prevention portion 50 during the connector fitting, a load can be physically applied before the male terminal 5 contacts the female terminal 18 as in the first embodiment. According to the connector 1, as can be seen from the above structure, the female-side pre-lock structure 20 can be provided in the female-side finger-touch prevention portion 34, and the male-side pre-lock structure 7 can also be provided in the male-side finger-touch prevention portion 50. That is, in the female connector 3, the female-side finger-touch prevention portion 34 and the female-side pre-lock structure 20 are not separately provided, and in the male connector 2, the male-side finger-touch prevention portion 50 and the male-side pre-lock structure 7 are not provided separately either. Therefore, the connector 1 can be provided without increasing the size also in the second embodiment.

In addition, it goes without saying that the present invention can be variously modified without departing from the gist of the present invention.

What is claimed is:

1. A connector comprising:

a finger-touch prevention portion that is provided in an entrance portion of a female terminal accommodation portion, has an opening, and prevents a finger of an operator from touching a female terminal; and a male terminal that has a recess into which the opening is fitted at a position before the male terminal contacts the female terminal and from which the opening is removed at a position after the male terminal contacts the female terminal, wherein the finger-touch prevention portion is configured to generate a force for biasing toward a center of the opening in a state where the opening is enlarged in diameter with insertion of the male terminal.

2. The connector according to claim 1, wherein the finger-touch prevention portion includes a plurality of members that are displaced toward the center of the opening.

3. The connector according to claim 1, wherein the finger-touch prevention portion includes an elastic member in which the opening is formed.

4. The connector according to claim 1, wherein the recess is formed over an entire circumference around a terminal axis and has a substantially V-shape as viewed in cross section.

5. A connector comprising:

a female-side finger-touch prevention portion that is provided in an entrance portion of a female terminal accommodation portion, has an opening, and prevents a finger of an operator from touching a female terminal; and a male-side finger-touch prevention portion that is provided as a part of a male terminal, and has a recess into which the opening is fitted at a position before the male terminal contacts the female terminal and from which the opening is removed at a position after the male terminal contacts the female terminal.

6. A connector comprising:

a female connector; and a male connector, wherein the female connector includes a female-side finger-touch prevention portion in an entrance portion of a female terminal accommodation portion, the male connector includes a male-side finger-touch prevention portion as a part of a male terminal, and the female-side finger-touch prevention portion and the male-side finger-touch prevention portion respectively have structures in which the female connector and the male connector are at a pre-lock position when the female-side finger-touch prevention portion and the male-side finger-touch prevention portion are fitted.

* * * * *